US005350265A

United States Patent [19]

Kinner

[11] Patent Number: 5,350,265

[45] Date of Patent: Sep. 27, 1994

[54] FITTING FOR BOLTED WOOD MEMBERS

[76] Inventor: David M. Kinner, P.O. Box 1502, Red Bluff, Calif. 96080

[21] Appl. No.: 144,323

[22] Filed: Nov. 1, 1993

[51] Int. Cl.[5] ..... F16B 39/24; F16B 43/02; E04C 3/02

[52] U.S. Cl. ..... 411/160; 411/383; 411/546; 52/693

[58] Field of Search ..... 411/160, 173, 177, 180, 411/187, 469, 531, 546, 383; 52/692, 693, 695, 696

[56] References Cited

U.S. PATENT DOCUMENTS

| | | | |
|---|---|---|---|
| 241,626 | 5/1881 | Davenport | 411/531 X |
| 2,092,684 | 9/1937 | Uhl | 411/531 X |
| 3,332,196 | 7/1967 | Tuttle | 411/160 X |
| 3,480,061 | 11/1969 | Leistner | 411/177 |
| 3,946,532 | 3/1976 | Gilb | 52/693 X |
| 3,985,459 | 10/1976 | Gilb | 52/693 X |
| 4,069,635 | 1/1978 | Gilb | 52/693 |
| 4,104,843 | 8/1978 | Gilb | 52/693 |

*Primary Examiner*—Neill R. Wilson

[57] ABSTRACT

A reinforcing fitting which widely distributes lateral stresses applied to wood members at the location where the wood is bolted to another member. The connection may be a wood member bolted to concrete, or bolted to steel, or two or more wood members bolted to one another. The fitting is generally comprised of a cylindrical metal tubular member having substantial wall thickness and a smooth-walled central bore in which an appropriately sized bolt shank may be positioned. A first or top end of the tubular member is affixed with a metal plate having a multiple of spikes projecting downward from the bottom surface of the plate. The tubular member is structured for insertion into a pre-drilled circular hole in a wood member, with a second or bottom end of the tubular member extending just short of the opposite side of the wood. The spikes depending from the bottom surface of the metal plate are structured to be hammered into the wood to secure the fitting in place and to more widely distribute loads around the tubular member. A bolt is applied through the bore of the tubular member to secure the wood member to another member. The external diameter of the tubular member is substantially larger, preferably twice as large as the diameter of the bolt, and thereby greater surface area is provided for the wood to abut under lateral loading and stresses.

2 Claims, 7 Drawing Sheets

FITTING FOR BOLTED WOOD MEMBERS

BACKGROUND OF THE INVENTION

1. Field of the Invention

This invention relates to load distributing or reinforcing fittings which more widely distribute lateral stresses applied to wood members at the location where the wood is bolted to another member.

2. Description of the Prior Art

In the past, the bolting of a wood member to another member, whether to concrete, to steel or another wood member, particularly when the bolted wood member is structural in application, required a relatively large bolt shank diameter in order to gain sufficient strengths during pulls and stresses of the wood against the shank of the bolt. Typically, when a given size steel bolt is specified and used to connect a structural wood member to another structure, the bolt shank is passed through a hole in the wood and fastened to the other member such as with a nut or is embedded in concrete to secure the wood member in place. The diameter of the steel bolt which is typically used provides several times more bolt shear strength than is required for the particular application, as the wood will split long before the bolt shank will shear. The diameter of the bolt provides more than just shear strength, also providing surface area for the wood to abut against under lateral loading, and therefore the size of the steel bolt shank is oftentimes not so much determined by the shear strength of the steel bolt itself, but rather by the required surface area of the bolt shank that the wood may abut during lateral loading. Insufficient bolt shank surface area provided against the wood during lateral loading will lead to the wood failing, and typically the failure of the wood will occur substantially prior to the shearing of the bolt shank.

In other words and for example, often a steel bolt having a ½" shank diameter will have far more than adequate shank shear strength for a given connection, however, load and stress calculations will call for a 1" diameter bolt in order to acquire adequate overall strength particularly during lateral loading. In this application, the ½" diameter bolt shank would be quite adequate from a bolt shear strength standpoint, however, the surface area of the ½" bolt shank to which the wood may abut is inadequate to provide the necessary connecting strength prior to the wood failing under lateral loading. The reason the 1" diameter bolt would be used is because the 1" diameter shank provides a much wider or greater surface area for the wood to abut against under lateral pulls (transverse to the lengthwise axis of the bolt shank) than the ½" diameter bolt. The much wider or greater abutment area provided by the 1" diameter bolt shank provides a greater distribution of load (stress) to the surrounding wood compared to the ½" bolt, and therefore the connection as a whole is stronger.

As bolt sizes increase, they rapidly increase in cost, and for example, a 1" diameter bolt is several times more expensive than a ½" diameter bolt of the same length. Additionally, 1" nuts and washers are also quite a bit more costly than ½" nuts and washers.

Therefore, it would be desirable to be able to standardize and utilize smaller and thus less expensive bolts to bolt wood structural members if adequate overall strength could be obtained. Additionally, current bolt shank sizing practices normally require the stocking of various bolt shank diameters on a construction site, and it would be desireable to reduce the number of different bolt sizes which would need to be stocked.

SUMMARY OF THE INVENTION

The present invention is a reinforcing fitting which more widely distributes lateral stresses applied to wood members at the location where the wood is bolted to another member. The connection may be a wood member bolted to concrete, or bolted to steel, or two or more wood members bolted to one another, as is often found in the structural frames of buildings. The fitting of the present invention allows for the use of a smaller bolt shank diameter than would otherwise be required, and thus a less expensive bolt, and from a strength and cost standpoint, the present reinforcing fitting and the smaller bolt is believed to provide the required overall strength and to be less expensive than utilizing a much larger bolt absent the present invention as is the standard procedure. Additionally, it is believed that my fitting will reduce the number of required bolt shank diameters to be stocked on a construction site by allowing the use of smaller bolts in application wherein typical practices would require an increase or step-up in bolt shank size.

DESCRIPTION OF THE PREFERRED EMBODIMENT

Figure 1:
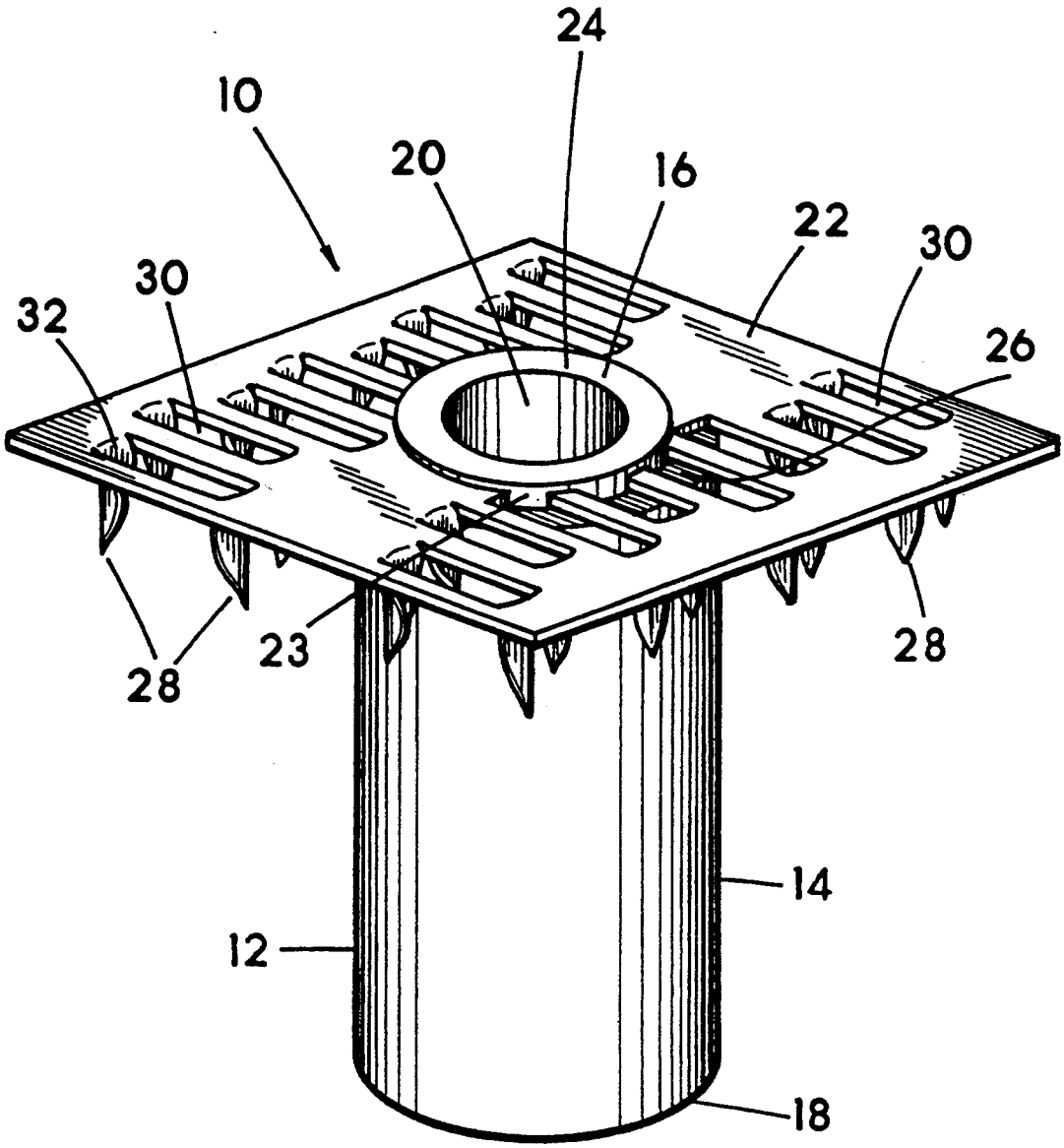
FIG. 1 is a top perspective view of one embodiment of my reinforcing fitting shown as an example, and showing a nail plate having a plurality of integrally formed spikes. The nail plate is shown connected perpendicularly to an end of a tubular member which has a substantial wall thickness.
Figure 2:
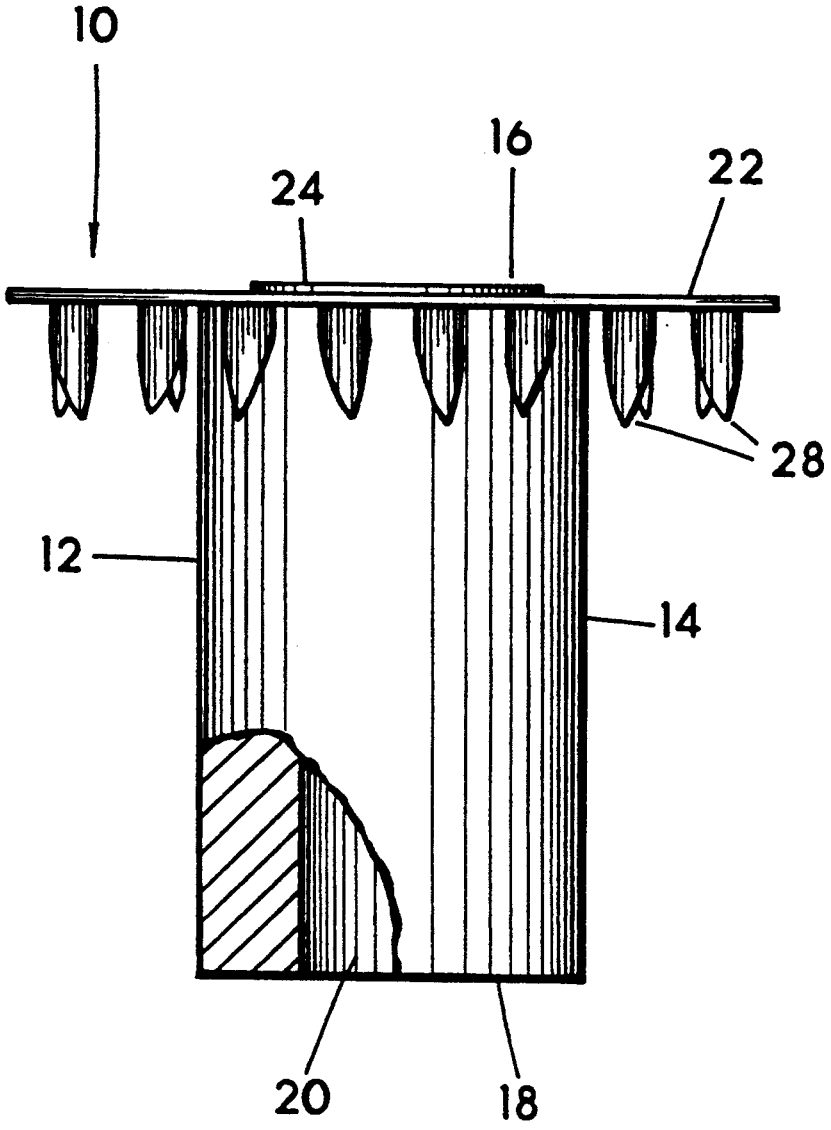
FIG. 2 is a front plan view of the embodiment shown in FIG. 1, with the back view appearing the same. A cut-away section of the annular wall of the tubular member is provided to show the substantial wall thickness of the tubular member.
Figure 4:
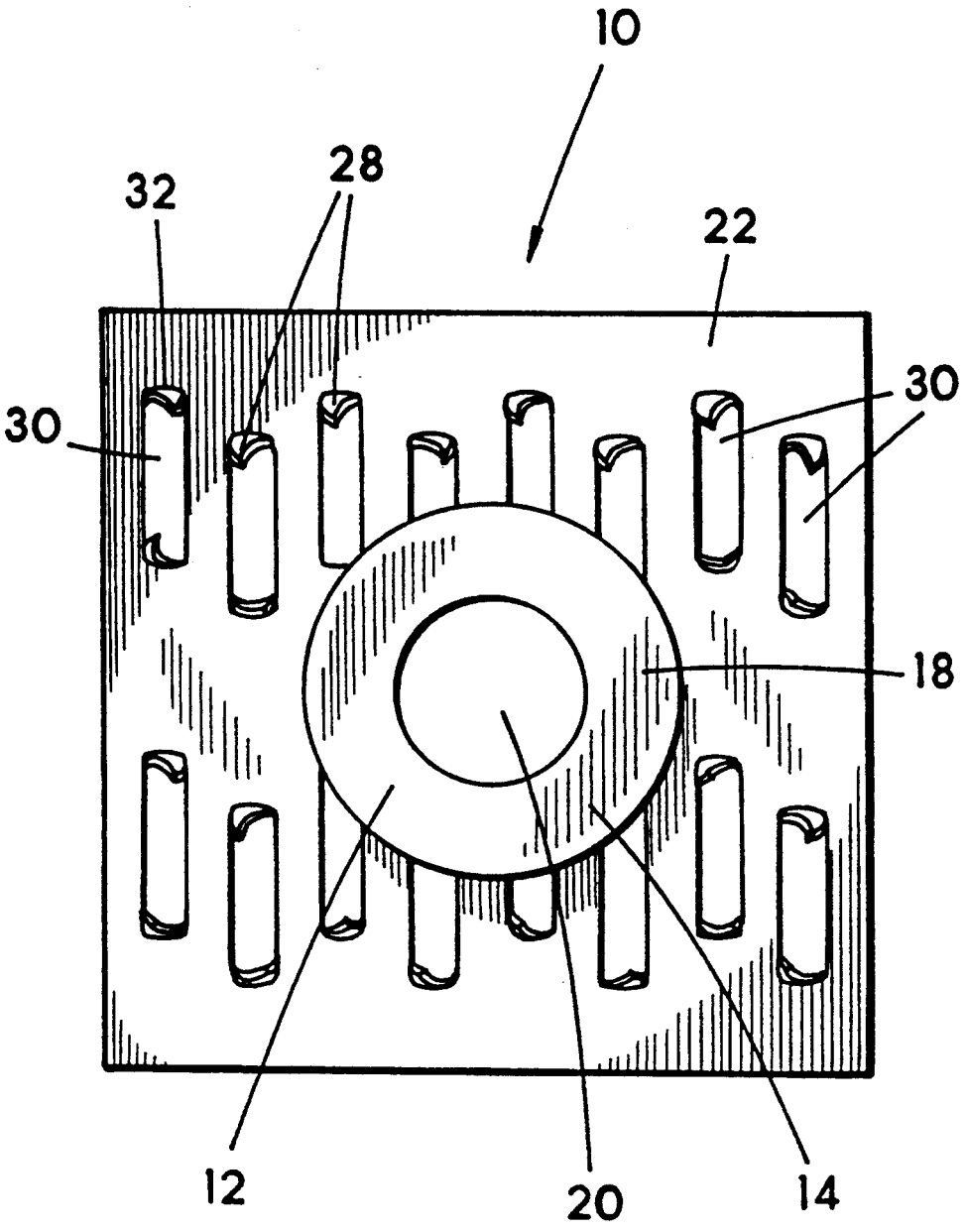
FIG. 4 is a bottom plan view of the embodiment shown in FIG. 1.

A detailed description of a preferred embodiment will now be given for example with reference to the included drawings, but it should be kept in mind that this is a preferred embodiment, and that some structural changes could be made within the true scope of the invention. My load distributing or reinforcing fitting 10 according to the present invention generally comprises an elongated tubular member 12 which is rigid, and defined by a rigid annular wall 14 having a top end 16 and an oppositely disposed bottom end 18. Bottom end 18 is cut or fashioned square or perpendicular to the length of tubular member 12 as may be seen in FIGS. 2 and 4. Annular wall 14, as may be seen in FIGS. 2 and 4 has substantial thickness, normally being of a thickness which provides a minimum of one-third greater exterior diameter than the diameter of central bore 20 extending lengthwise through tubular member 12 from the top end 16 to the bottom end 18. The minimum of one-third greater exterior diameter than the diameter of central bore 20 mentioned in the previous sentence is that any less than this would seem relatively meaningless within the intended function of the invention, and in most cases it is preferred that annular wall 14 have a thickness which will render the external diameter of tubular member 12 about two times the diameter of central bore 20, and thereby for example, a ½" bolt shank when used with my invention would provide about a 1" diameter member for wood to abut during lateral loading. The external diameter of the major portion of tubular member 12 being about twice the diameter of central bore 20 in effect allows the use of a bolt having a given diameter which is just slightly smaller than the diameter of central bore 20 to be slipped into bore 20, and tubular member 12 to be inserted into a hole in wood, wherein if the wood is pulled transversely to the tubular member 12, assuming the bolt is anchored, the surface area against which the wood abuts is substantially greater, preferably twice as great, than if the wood were abutting the relatively small bolt, and therefore the wood is less likely to fail (split). The bolt inserted into bore 20 should be only slightly smaller than the bore 20, and this being to assist in preventing the tubular member 12 from being collapsed or crushed or deformed under extreme loads, and to prevent the wood member from being pulled toward or away from the bolt as would be allowed if there were significant play between the bolt and the wall defining bore 20. The bore 20 defined by annular wall 14 is smooth walled its full length, being absent threads since a bolt does not threadably engage with fitting 10.

Figure 3:
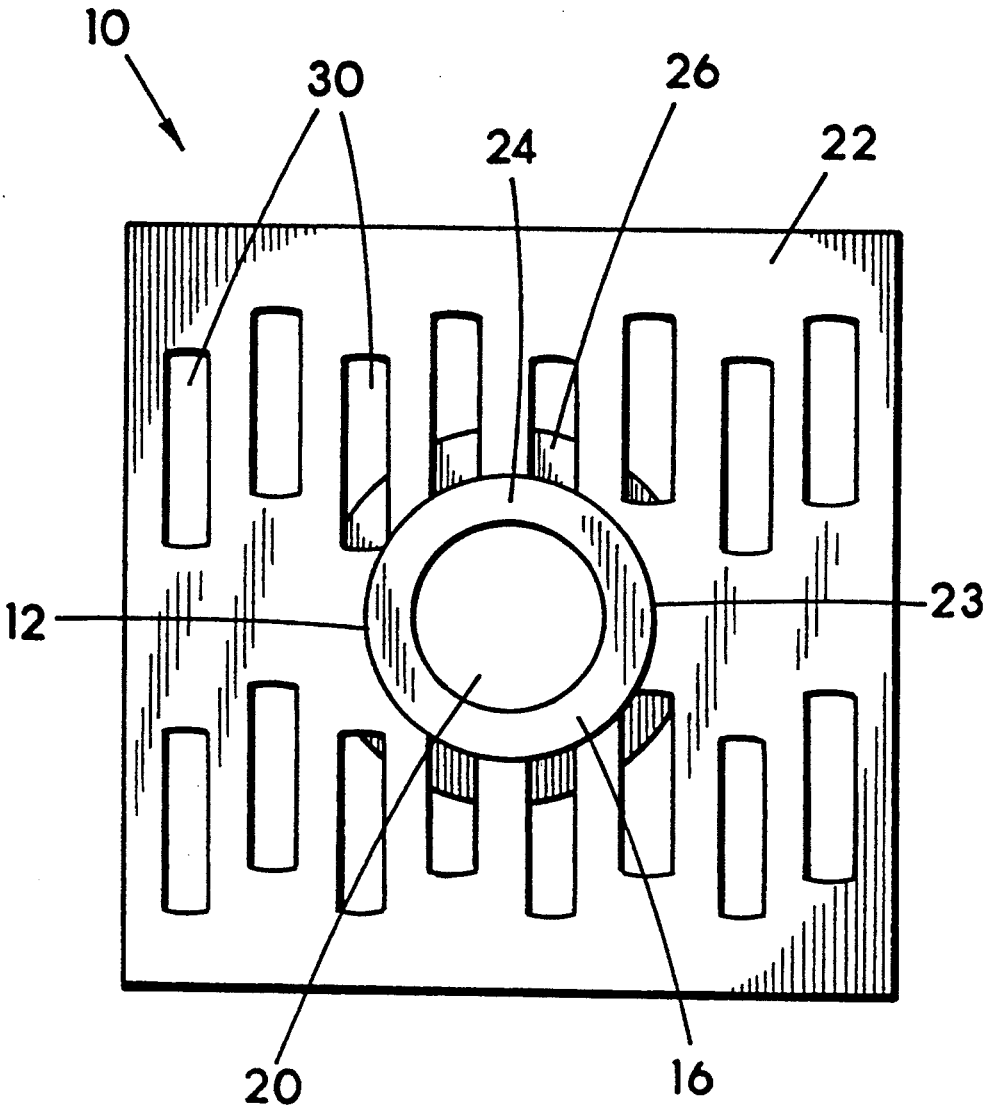
FIG. 3 is a top plan view of the embodiment shown in FIG. 1.

Securely attached to the top end 16 of tubular member 12 is a rigid nail plate 22. Nail plate 22 in this example includes a bolt hole designated central aperture 23 positioned over a short reduced external diameter portion 24 at top end 16 of tubular member 12. Reduced external diameter portion 24 is fashioned by providing an annular notch or recess at the top terminal end of the tubular member 12 which defines an annular ledge 26 on which the underside of nail plate 22 abuts and rests as may best be seen in FIG. 3. The portion of the reduced diameter top end of the tubular member 12 is just long enough relative to the thickness of nail plate 22 so as to extend slightly above the top or upper surface of nail plate 22, thus allowing this extending portion to be peened or flattened outward over the top surface edges of the plate 22 defining the aperture 23, and thus the plate 22 is securely attached to the tubular member 12. The nail plate 22 could also be welded to the end of tubular member 12, and the welding could be done whether or not reduced external diameter portion 24 is utilized, provided the aperture 23 (bolt hole) is aligned with central bore 20 of tubular member 12, and the nail plate 22 is securely attached. Aperture 23 needs to be at least as large as bore 20 and aligned therewith, so that a bolt shank may be inserted through the assembly. Nail plate 22 and tubular member 12 could be formed or cast as a single integral component, and both nail plate 22 and tubular member 12 should be rigid and strong, and are preferably made of a metal, such as steel, pot metal or aluminum for example, or possibly combinations thereof, and nail plate 22 as will be appreciated with further reading, should not be so brittle as to break if struck with a hammer. I have also considered that it might be possible to make tubular member 12 out of a rigid polymer (plastics), and possibly even nail plate 22 for that matter, however, tubular member 12 is probably best made out of steel or pot metal, and nail plate 22 is probably best made out of sheet metal (steel) for reasons pertaining to the ready availability of the materials, the strengths associated therewith, and for economic reasons. I have considered making tubular member 12 out of rigid plastics and attaching a nail plate 22 which is made out of sheet metal thereto, as this structure could be quite adequate from a strength standpoint, and might be quite inexpensive to manufacture. Nail plate 22 in this example is affixed perpendicularly to the lengthwise axis of tubular member 12.

Nail plate 22 serves several purposes, with one being to limit the passage of tubular member 12 when inserted into a hole in a wood member; and two, temporarily maintain the fitting 10 in place prior to securing with a bolt, with this aspect being especially useful in overhead applications where gravity would draw the fitting 10 out of the hole in the wood member prior to completing the installation; and three, and most importantly, to more widely distribute stresses and loads applied to the wood around tubular member 12, with this being because the plate 22 includes a plurality of rigid nails or spikes 28 which are driven into the wood and secure the plate 22 to the wood outward around the top end of tubular member 12. As shown in the drawings, plate 22 is in this example is square or rectangular, extending outward beyond tubular member 12, and having a plurality of elongated rectangular openings 30. Openings 30 in this example are formed by stamping with a die stamp tool or punch press through the material and leaving the cut material connected at 32 at each opposite end of the opening 30, and cutting the still connected material to define two spikes 28 per opening 30 having sharp points, and bending the spikes 28 downward, both in the same direction so that they are aiming toward bottom end 18 of tubular member. The process of stamping the plate 22 to define spikes 28 is one efficient process of defining a plurality of integral spikes or nails on the plate 22, and the same stamping process could be used to define a single spike 28 per opening 30, and these single spikes 28 would be longer than that which is shown in the drawings as they would be of a length being substantially equal in length to that of the opening 30. Most likely the stamping to form spikes 28 will be done prior to attaching nail plate 22 to tubular member 12. Other structural arrangements could also be used instead of the integrally formed spikes 28. For example, nail plate 22 could be absent openings 30 and spikes 28, and instead have a number of small round nail holes which the installer would drive standard large headed nails through to attach the nail plate 22 to a wood member, however, I prefer affixed in place nails or spikes as they would be generally more convenient and probably more economical.

Figure 5:
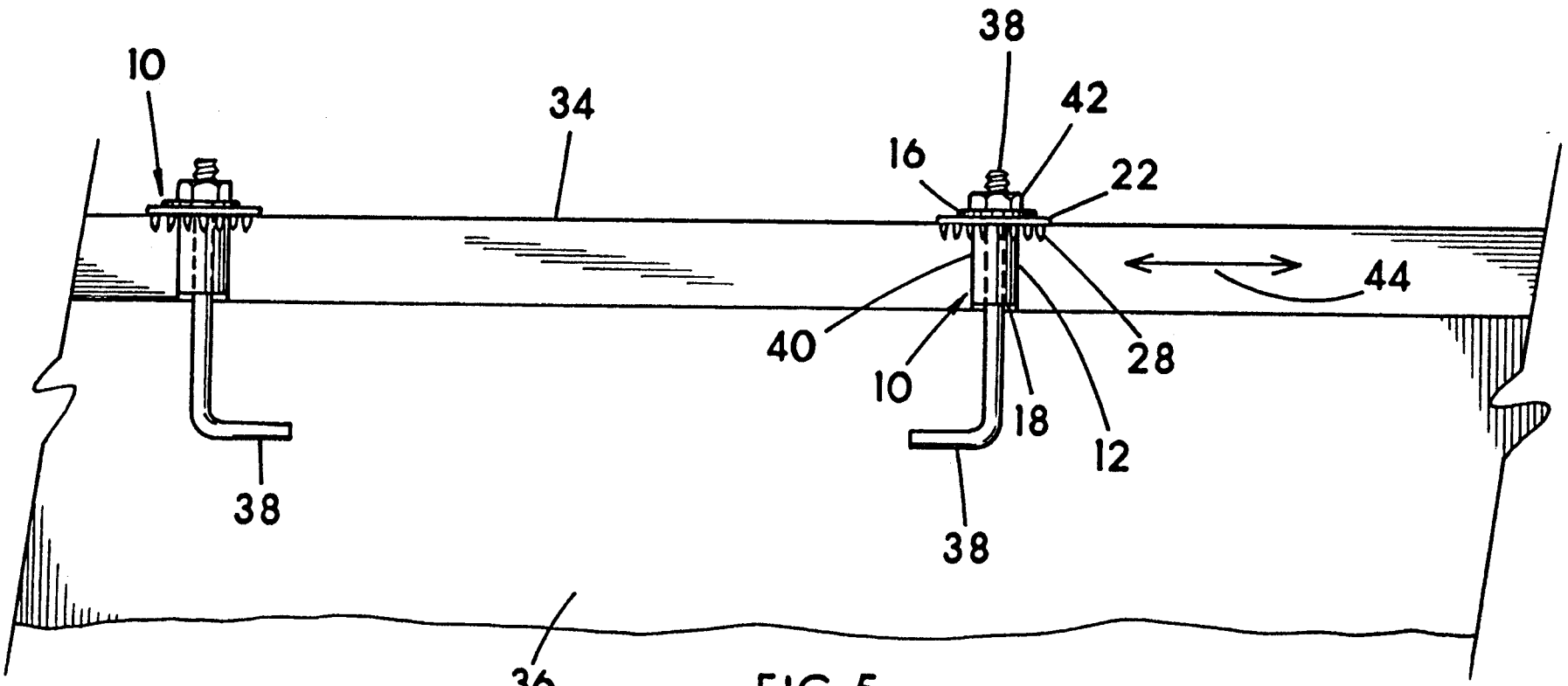
FIG. 5 illustrates my reinforcing fitting used to secure a mud sill plate to a concrete foundation with the use of J-style bolts.
Figure 6:
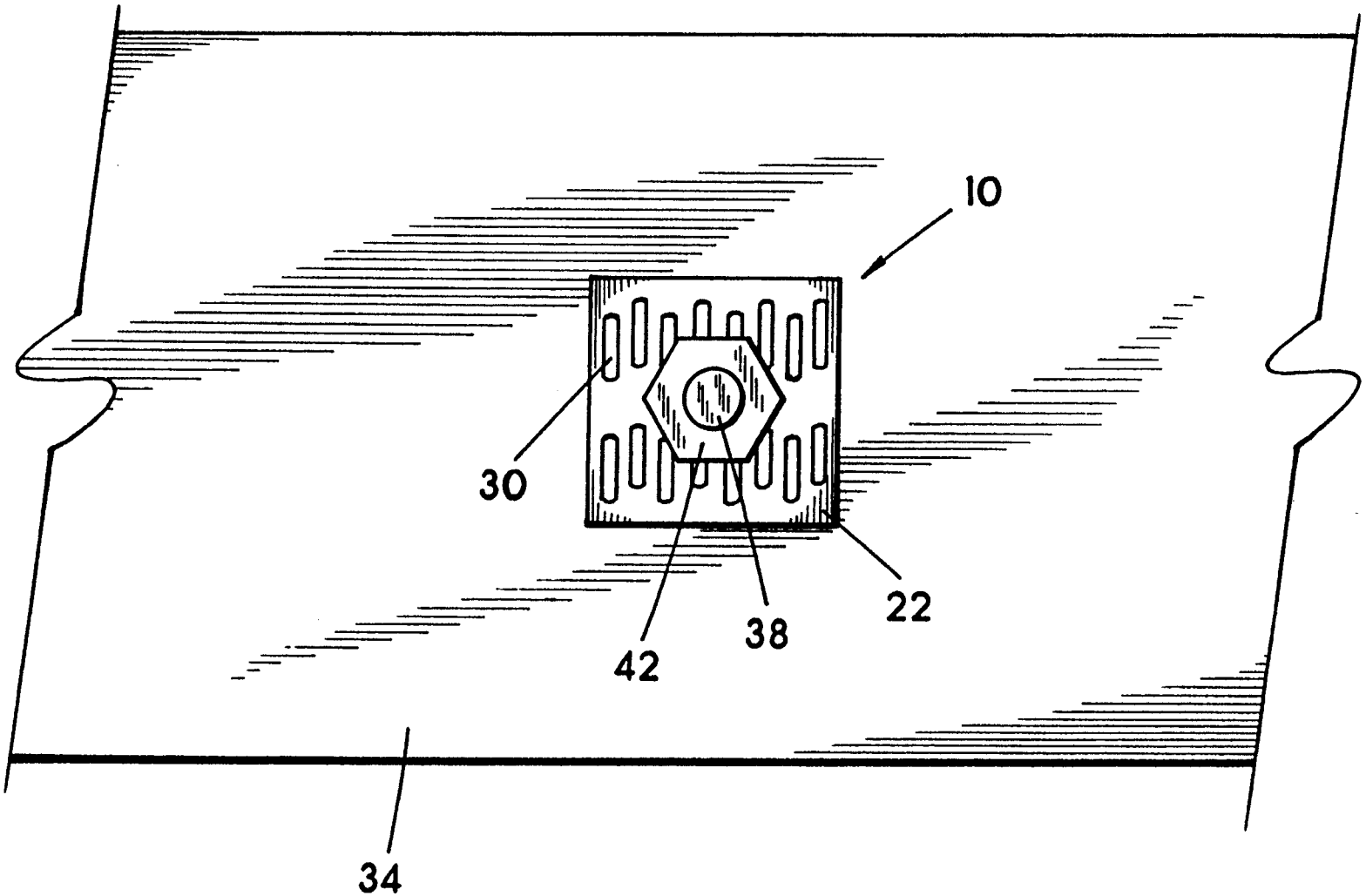
FIG. 6 is a top view of my fitting as shown in FIG. 5.
Figure 7:
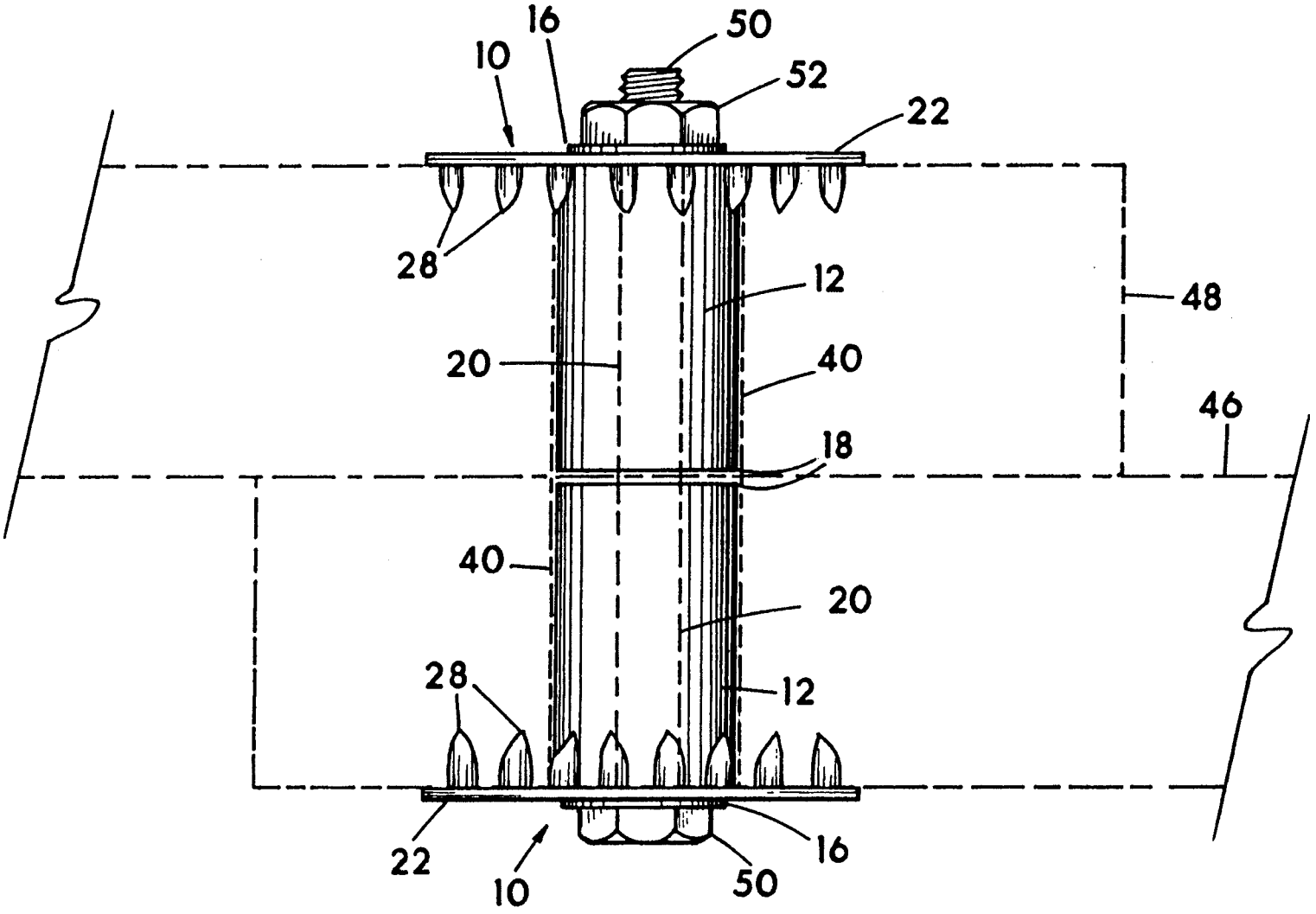
FIG. 7 shows two wood members bolted together utilizing two of my load distributing or reinforcing fittings in accordance with the present invention.

Referring now to FIGS. 5–7 for a detailed description of the use or application of the present invention. FIGS. 5–6 represent fitting 10 being used in the bolting application of a wood member 34 to a foundation of concrete 36 using J-style bolts 38 wherein the bottom ends of the bolts 38 are embedded in the concrete 36, and the wood member 34 includes a hole 40 bored transversely through the wood and placed over the J-bolts. The hole 40 in the wood is bored completely through the wood member 34, and its diameter is approximately the same as the external diameter of tubular member 12, plus a small increase so that the tubular member 12 may be easily slipped into the hole 40. The length of tubular member 12 should be just slightly less than the thickness of the wood or depth of the hole 40 so that when stresses or loads pull the wood member 34 transversely or laterally into the tubular member 12 as indicated by stress direction arrow 44 in FIG. 5, as much surface area of the wood abuts the tubular member 12 as is possible. Such stresses as indicated in FIG. 5 by arrow 44 are most prevalent in a building during an earthquake. Once tubular member 12 of fitting 10 is slipped into a properly sized hole 40, a hammer should be used to tap on nail plate 22 to drive spikes 28 into the wood. When using already anchored bolts such as J-bolts 38 embedded in concrete as shown in FIG. 5, the upper end of a single bolt 38 would be extending through the center of hole 40 in wood member 34 when fitting 10 is installed. Once fitting 10 is in place, then a nut 42 is applied to the upper threaded end of the bolt 38 and tightened downward onto plate 22 to complete installation. Nail plate 22 serves as a washer, being substantially larger than the diameter of nut 42, and therefore a washer as is commonly applied underneath a nut on a J-bolt would normally not be necessary to apply with the use of fitting 10. FIG. 6 is a top view of one of the fittings 10 of FIG. 5.

Referring now to FIG. 7 wherein two wood members 46 and 48 are shown overlapping one another and connected together by two fittings 10, one or more fitting 10 per each wood member. In this application the wood members 46 and 48 have each been drilled to include a hole 40, which are aligned with one another. A fitting 10 is inserted from the outside surface of each wood member, spikes 28 are driven into the wood, and a single bolt 50 has been insert through the center of the two fittings 10. A nut 52 has been applied to complete the installation. This installation is one which might be used in roof trusses for example, although there are potentially many other applications. Additionally, it should be noted that a third wood member could be applied in the arrangement of FIG. 7, and in this case the third member would have an aligned hole 40, and one of the fittings 10 shown in the drawing would have a tubular member 12 lengthened the approximate thickness of the third wood member so that the longer tubular member 12 would be inserted in two of the wood members. This same principle of the lengthened tubular member 12 would be used for a forth or any number of wood members ganged together. In FIG. 7, the bottom ends 18 of the tubular members 12 are not abutting, but are in close proximity, as it is the wood which is desired to be tightly abutted by the tightening of the nut 52 on bolt 50. With the present invention, the wood is less apt to fail regardless as to whether the forces or loads are parallel or perpendicular to the wood grain.

Additionally it should be noted that in construction there are situations where a single wood member such as a vertically oriented wall stud is secured to a metal bracket such as an earthquake holddown via a single bolt passed through a single transverse hole through the wood member. In this application, since the plate 22 with nails or spikes 28 of fitting 10 does add to the overall strength of the connection by further distributing loads, then it would be possible to utilize two fittings 10 each having a tubular member 12 equal in length to approximately ½ the thickness of the wood member to be bolted to the hold-down. In this application, each fitting 10 would be installed into the hole of the wood from oppositely disposed sides of the wood, and this would result in a plate 22 with spikes 28 on each opposite side of the hole and wood member, rendering greater strength potential than if a single fitting 10 having a tubular member 12 equal in length to the thickness of the wood member were used, because an additional nail plate 22 has been applied.

Although I have very specifically described the preferred structures and use of the invention, it should be understood that some changes in the specific structures described and shown in my drawings may clearly be made without departing from the true scope of the invention in accordance with the appended claims.

What I claim as my invention is:

1. A lateral load distributing fitting for use in combination with a bolt to connect a wood member to another member so as to provide substantially greater surface area around the bolt for the wood member to abut against during lateral pulling of the wood member transversely relative to the bolt and thereby allow for use of a smaller bolt absent a reduction in connecting strengths, said lateral load distributing fitting comprising, an elongated rigid tubular member having a top end and an oppositely disposed bottom end, said tubular member defined by an annular wall having substantial thickness rendering said tubular member in diameter at least one-third larger than a central bore extending through said tubular member from said bottom end through said top end, said central bore being absent threads so as to allow a bolt shank of slightly less diameter relative to said central bore to be slipped through said central bore, a nail plate having a bolt hole therethrough, said nail plate securely affixed to the top end of said tubular member with the bolt hole of said nail plate aligned with the central bore of said tubular member, said nail plate having a plurality of rigid spikes extending from an underside of said nail plate in the direction of said bottom end of said tubular member, said plurality of rigid spikes being sufficiently rigid so as to allow driving of said spikes into the wood member with said top end of said tubular member facing outward away from the wood member and with said tubular member positioned within an aperture completely through the wood member, said tubular member extending from said underside of said nail plate a distance about equal in length to the aperture through the wood member so as to provide substantially greater surface area around a bolt when positioned within said central bore for the wood member to abut against during lateral pulling of the wood member transversely relative to the bolt, said nail plate with said rigid spikes providing further means for distributing lateral loads between and around the wood member and the bolt.

2. A combination of a lateral load distributing fitting and a bolt connecting a wood member to a second member with said lateral load distributing fitting providing substantially greater surface area around said bolt for said wood member to abut against during lateral pulling of said wood member transversely relative to said bolt, said lateral load distributing fitting including an elongated rigid tubular member having a top end and an oppositely disposed bottom end, said tubular member defined by an annular wall having substantial thickness rendering said tubular member in diameter at least one-third larger than a central bore extending through said tubular member from said bottom end through said top end, said central bore being absent threads, said lateral load distributing fitting further including a nail plate having a bolt hole therethrough, said nail plate securely affixed to said top end of said tubular member with said bolt hole of said nail plate aligned with said central bore of said tubular member, said nail plate having a plurality of rigid spikes extending from an underside of said nail plate in the direction of said bottom end of said tubular member, said plurality of rigid spikes extending into said wood member with said top end of said tubular member facing outward away from said wood member and with said tubular member positioned within an aperture completely through said wood member, said tubular member extending from said underside of said nail plate a distance about equal in length to said aperture through said wood member, said bolt positioned within and extending through said central bore of said tubular member and extending into said second member whereby said tubular member provides substantially greater surface area around said bolt within said central bore for said wood member to abut against during lateral pulling of said wood member transversely relative to said bolt, said nail plate with said rigid spikes providing further means for distributing lateral loads between and around said wood member and said bolt.

* * * * *